US011199349B2

(12) United States Patent
Pirmez et al.

(10) Patent No.: US 11,199,349 B2
(45) Date of Patent: Dec. 14, 2021

(54) HEAT SOURCE UNIT AND AIR CONDITIONER HAVING THE HEAT SOURCE UNIT

(71) Applicants: DAIKIN INDUSTRIES, LTD., Osaka (JP); DAIKIN EUROPE N.V., Ostend (BE)

(72) Inventors: Pieter Pirmez, Ostend (BE); Satoshi Kawano, Ostend (BE); Akiharu Kojima, Osaka (JP)

(73) Assignees: DAIKIN INDUSTRIES, LTD., Osaka (JP); DAIKIN EUROPE N.V., Ostend (BE)

( * ) Notice: Subject to any disclaimer, the term of this patent is extended or adjusted under 35 U.S.C. 154(b) by 87 days.

(21) Appl. No.: 16/481,265

(22) PCT Filed: Feb. 9, 2018

(86) PCT No.: PCT/JP2018/004607
§ 371 (c)(1),
(2) Date: Jul. 26, 2019

(87) PCT Pub. No.: WO2018/147414
PCT Pub. Date: Aug. 16, 2018

(65) Prior Publication Data

US 2019/0376733 A1 Dec. 12, 2019

(30) Foreign Application Priority Data

Feb. 10, 2017 (EP) ..... 17155598
Jul. 20, 2017 (EP) ..... 17182313

(51) Int. Cl.
*F25B 13/00* (2006.01)
*F25B 49/02* (2006.01)
(Continued)

(52) U.S. Cl.
CPC ..... *F25B 49/02* (2013.01); *F24F 1/24* (2013.01); *F25B 13/00* (2013.01); *F25B 41/20* (2021.01);
(Continued)

(58) Field of Classification Search
CPC ..... F25B 49/022; F25B 49/02; F25B 41/20; F25B 2600/0253; F25B 2700/21173
See application file for complete search history.

(56) References Cited

U.S. PATENT DOCUMENTS

2004/0159111 A1* 8/2004 Takegami ..... F25B 31/004 62/84
2012/0180510 A1* 7/2012 Okazaki ..... F25B 13/00 62/218
(Continued)

FOREIGN PATENT DOCUMENTS

JP 2013213670 A 10/2013
JP 2014066410 A 4/2014
(Continued)

OTHER PUBLICATIONS

Extended European Search Report issued in corresponding European application No. 17182313.1 dated Mar. 23, 2018 (7 pages).
(Continued)

*Primary Examiner* — Elizabeth J Martin
*Assistant Examiner* — Nael N Babaa
(74) *Attorney, Agent, or Firm* — Osha Bergman Watanabe & Burton LLP

(57) ABSTRACT

A heat source unit for an air conditioner that includes a refrigerant circuit, the heat source unit includes: an external housing; and a cooling heat exchanger disposed in the external housing and that is connected to the refrigerant circuit. The external housing accommodates: a compressor connected to the refrigerant circuit; a heat source heat
(Continued)

exchanger that is connected to the refrigerant circuit and that exchanges heat between a refrigerant circulating in the refrigerant circuit and a heat source; and an electric box. The electrical box: includes a top and a plurality of side walls; accommodates electrical components that control the air conditioner; and further includes an air passage that includes an air inlet and an air outlet. An air flow is induced through the air passage from the air inlet to the air outlet for cooling at least some of the electrical components.

9 Claims, 8 Drawing Sheets

(51) Int. Cl.
*F24F 1/24* (2011.01)
*F25B 41/20* (2021.01)

(52) U.S. Cl.
CPC .... *F25B 49/022* (2013.01); *F25B 2600/0253* (2013.01); *F25B 2600/2501* (2013.01); *F25B 2700/21173* (2013.01)

(56) References Cited

U.S. PATENT DOCUMENTS

2012/0255318 A1 10/2012 Kido et al.
2013/0247603 A1 9/2013 Margotti et al.
2014/0250929 A1 9/2014 Takahashi et al.
2015/0224849 A1 8/2015 Takeuchi et al.
2015/0256032 A1* 9/2015 Gatto ..... H02J 13/0017 307/35
2016/0258636 A1 9/2016 Kim et al.
2018/0080697 A1* 3/2018 Okuda ..... F25B 49/02

FOREIGN PATENT DOCUMENTS

JP 5516602 B2 6/2014
JP 2014109410 A 6/2014
JP 2016-191505 A 11/2016

OTHER PUBLICATIONS

International Search Report issued in corresponding International application No. PCT/JP2018/004607 dated May 18, 2018 (4 pages).
Notification of Transmittal of Translation of International Preliminary Report on Patentability for International Application No. PCT/JP2018/004607 dated Aug. 22, 2019 (1 page).
International Preliminary Report on Patentability issued in corresponding International Application No. PCT/JP2018/004607 dated Aug. 13, 2019 (6 pages).

* cited by examiner

[Fig. 1]
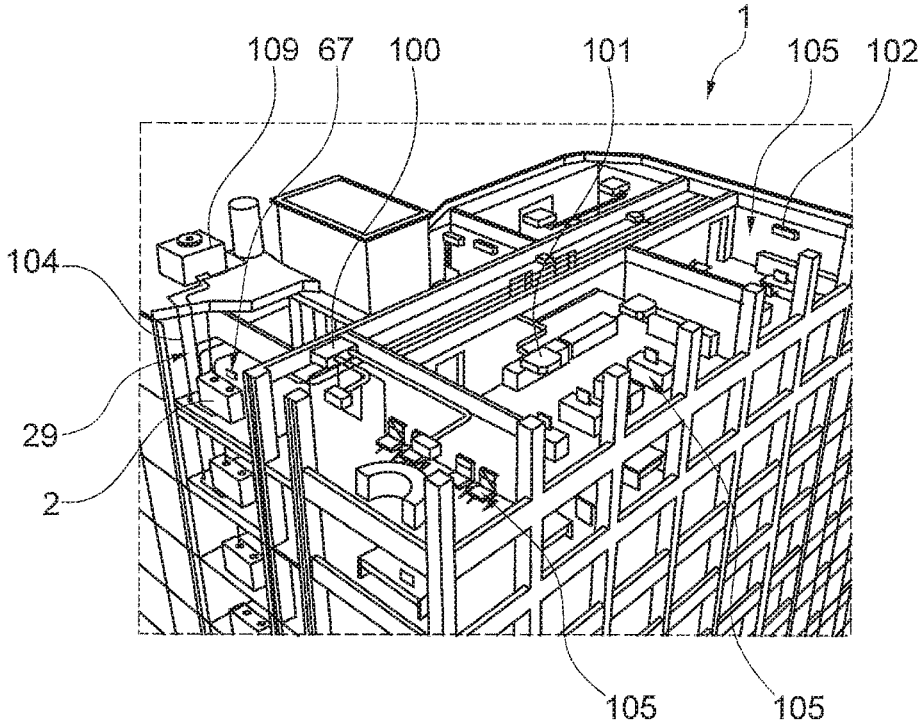
[Fig. 2]
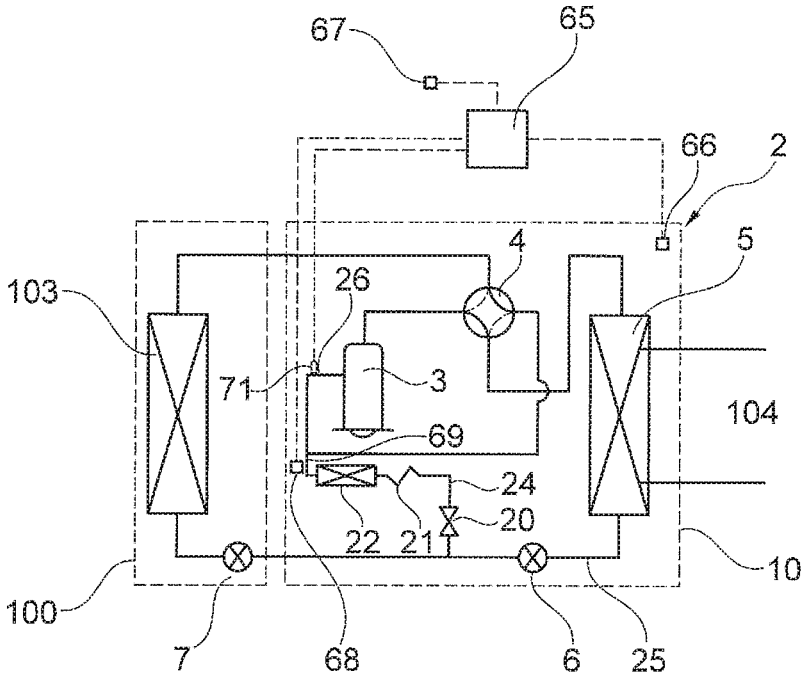

[Fig. 3]
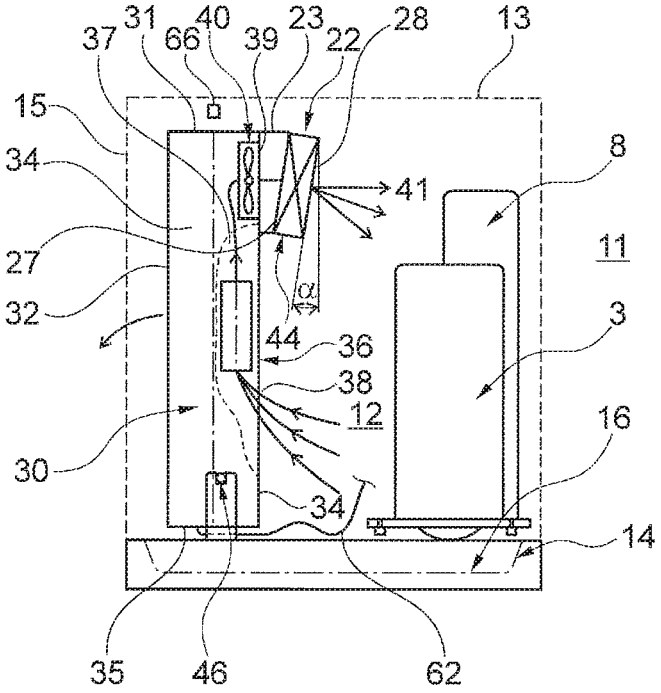
[Fig. 4]
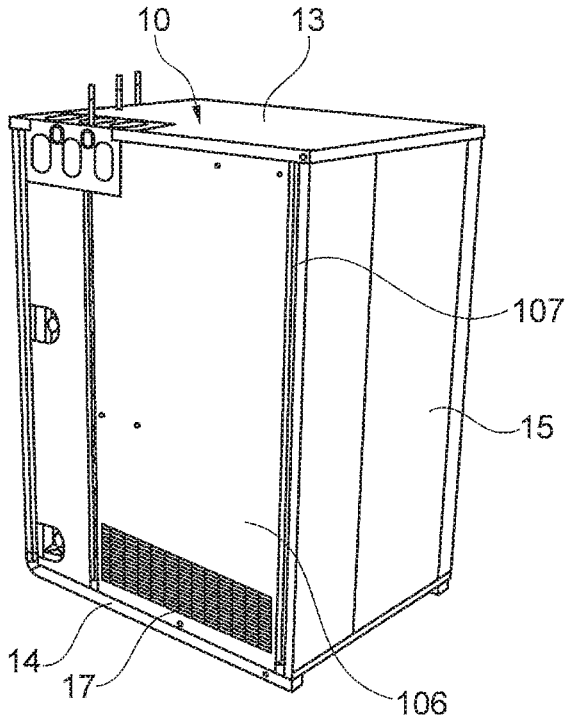

[Fig. 5]
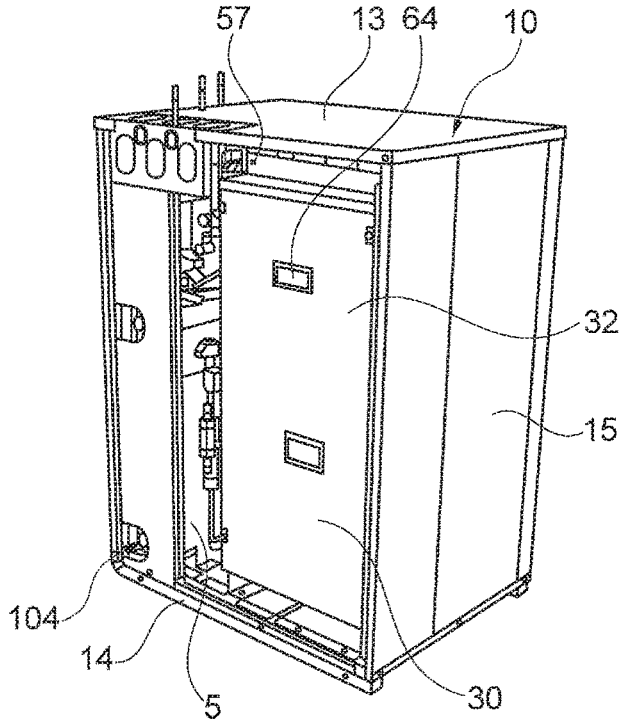
[Fig. 6]
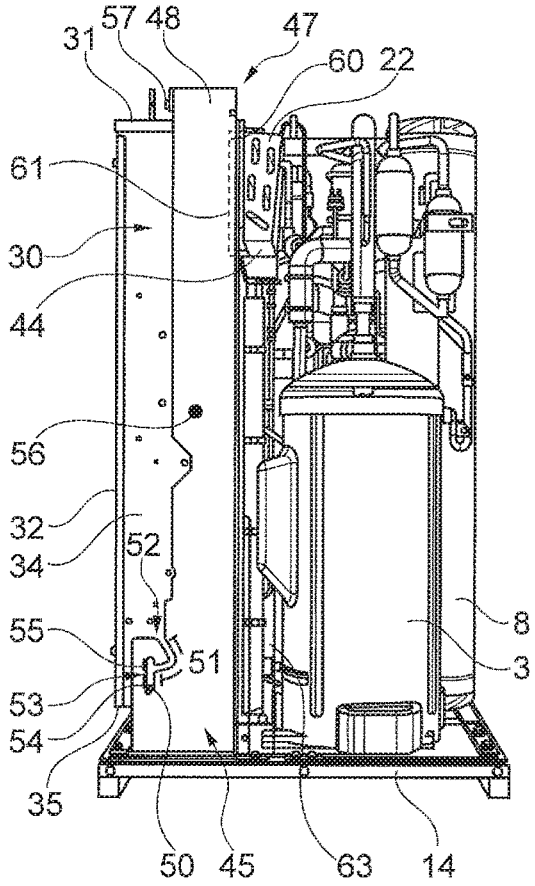

[Fig. 7]
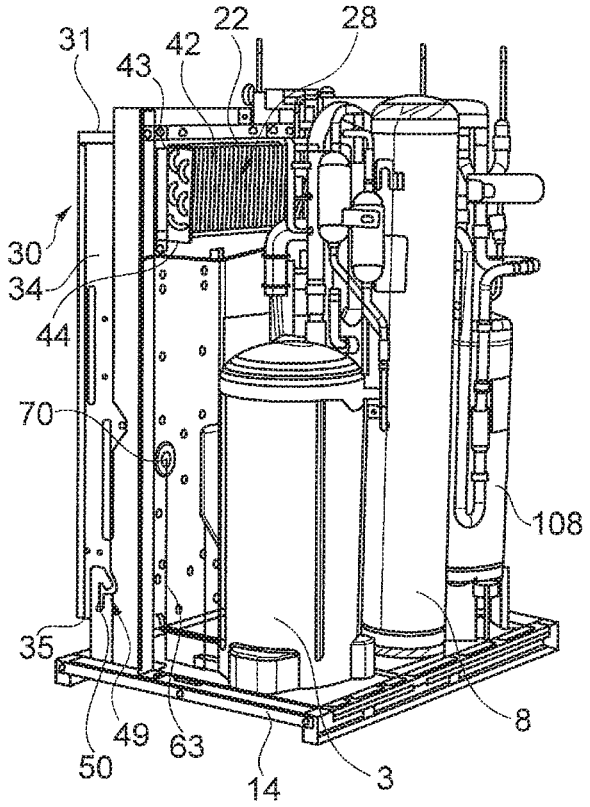
[Fig. 8]
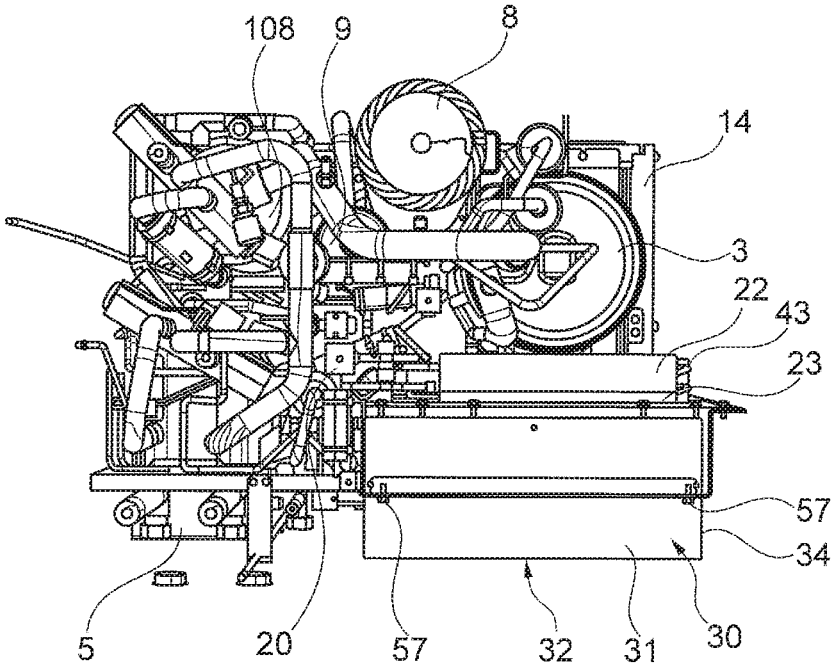

[Fig. 9]
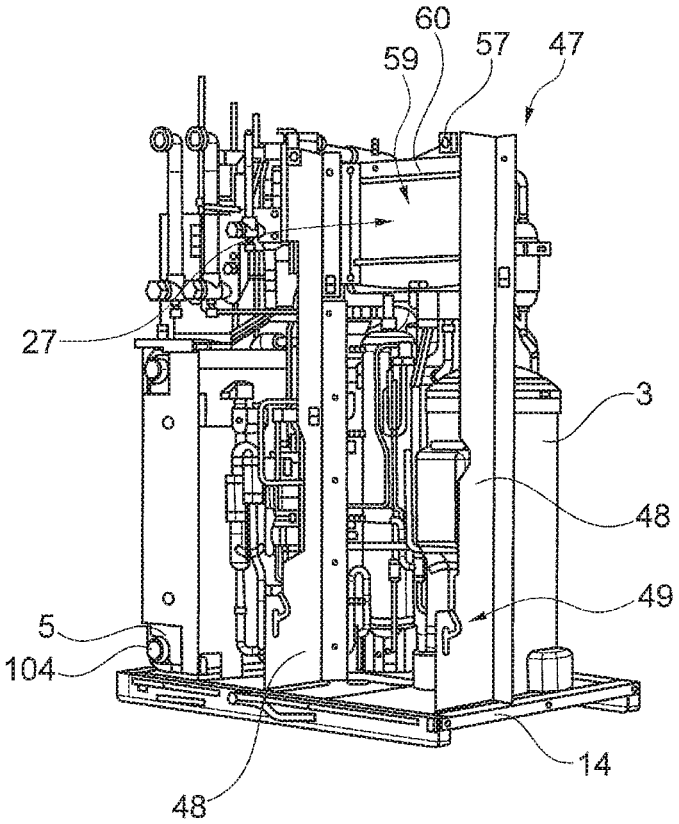
[Fig. 10]
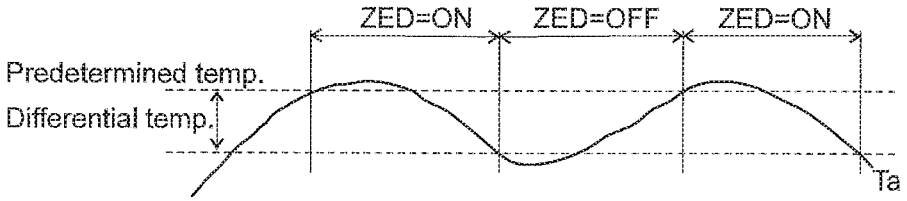

[Fig. 11]
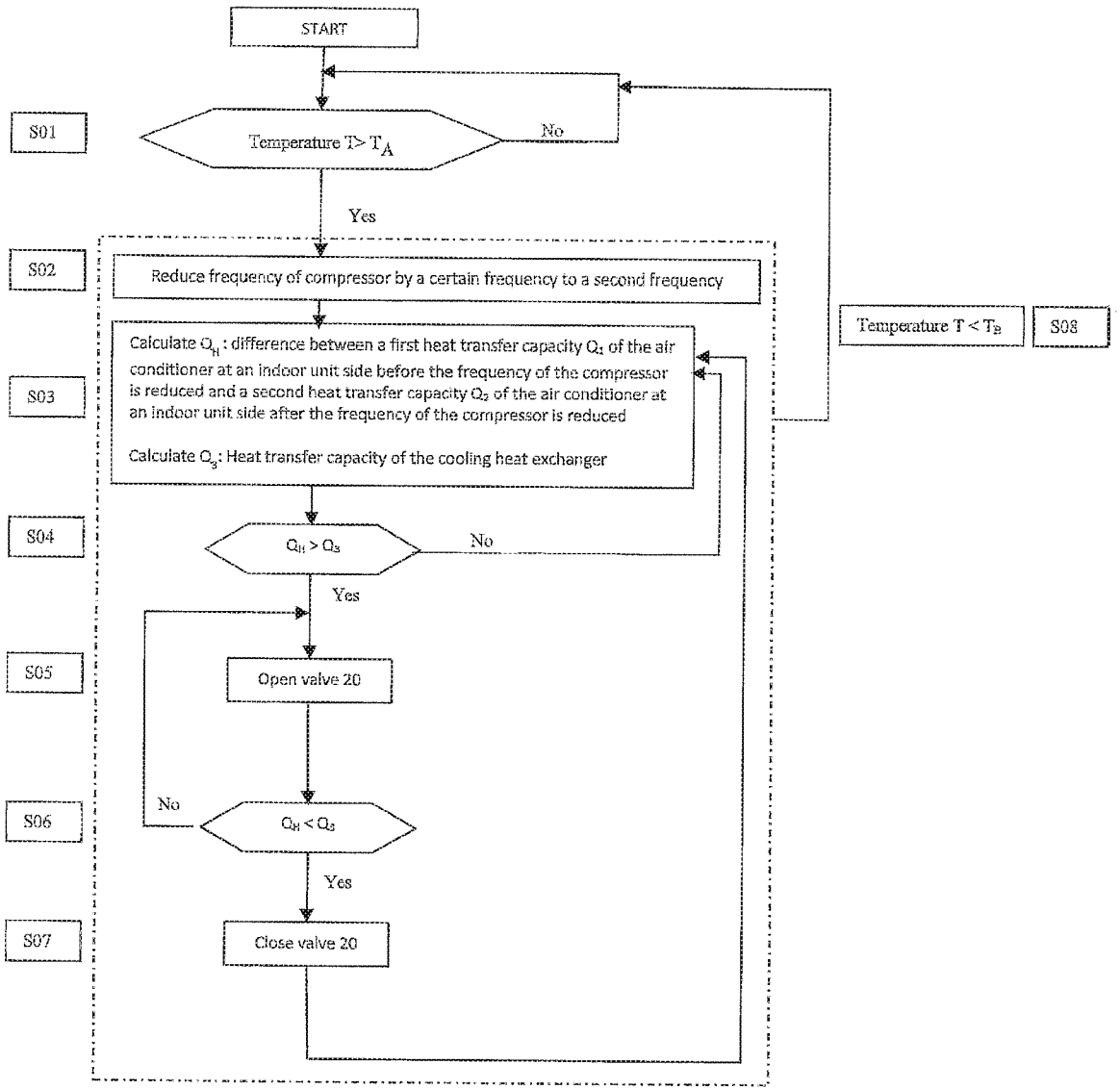

[Fig. 12]
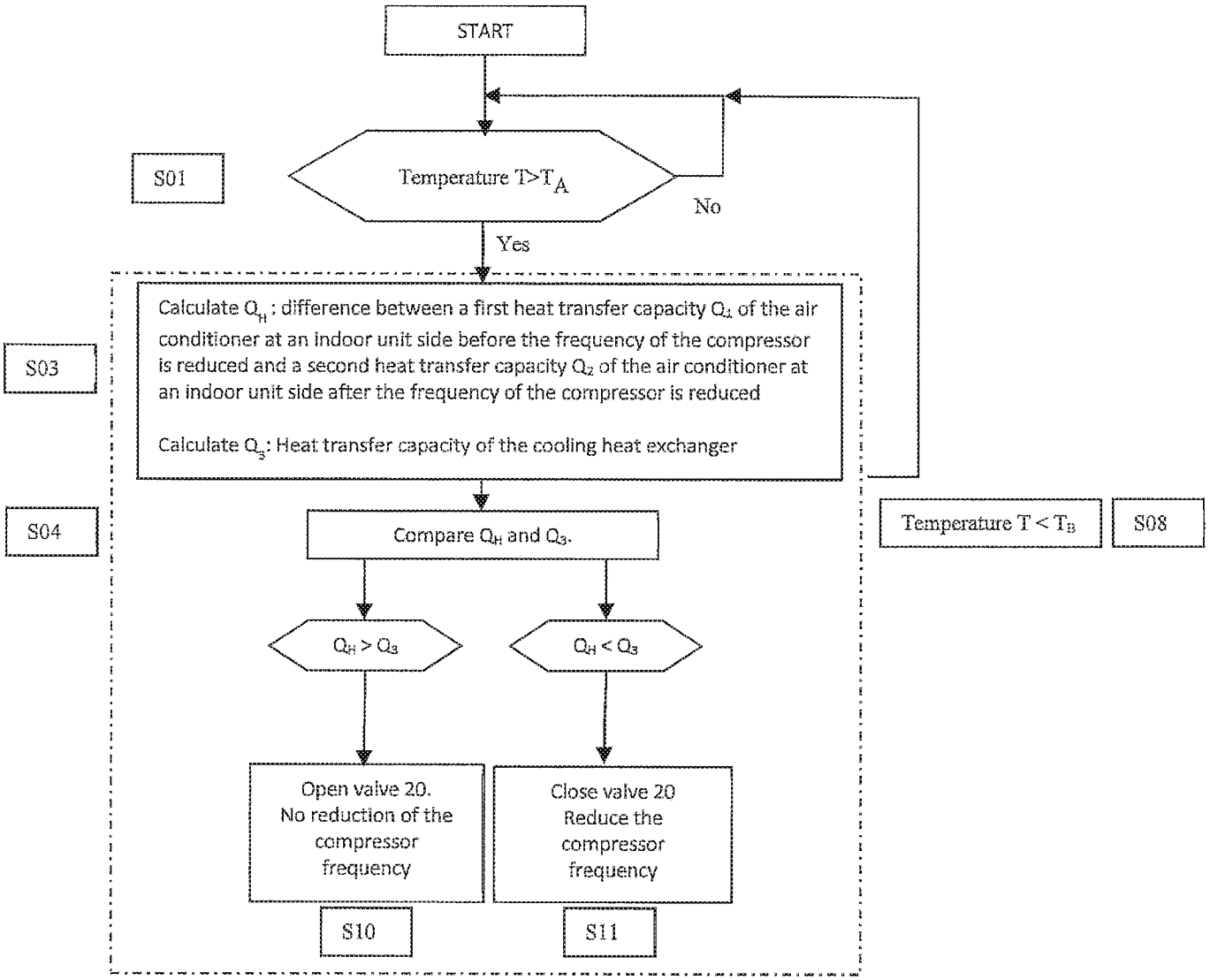

[Fig. 13]
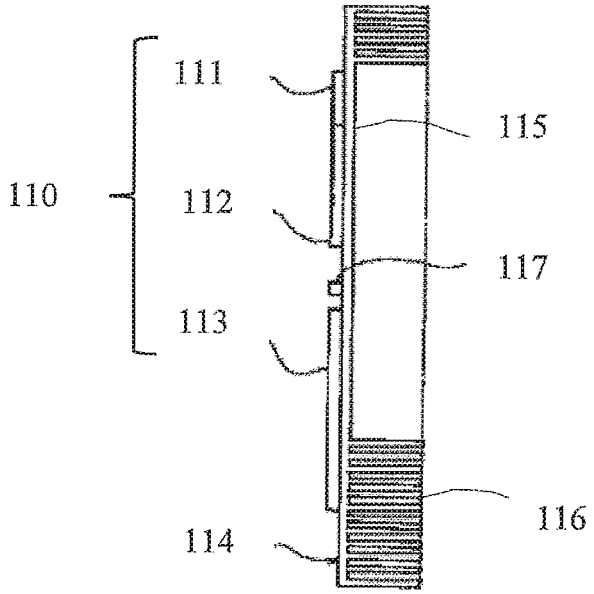
[Fig. 14]
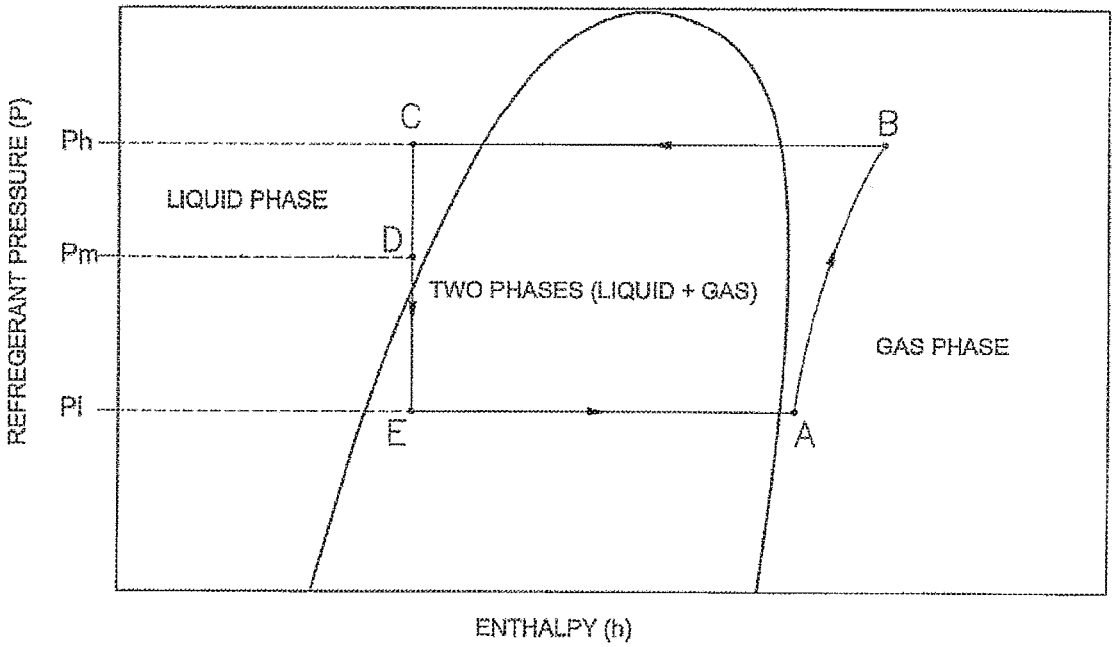

HEAT SOURCE UNIT AND AIR CONDITIONER HAVING THE HEAT SOURCE UNIT

TECHNICAL FIELD

The present disclosure relates to a heat source unit and an air conditioner having the heat source unit. Air conditioners generally employ a heat pump to cool and/or heat air in one or more rooms to be conditioned. The heat pump generally comprises a refrigerant circuit having at least a compressor, a heat source heat exchanger, an expansion valve and at least one indoor heat exchanger. The heat source unit is to be understood as the unit of the air conditioner (heat pump) that comprises the heat source heat exchanger used to transfer heat energy between a source of heat, such as air, ground or water, and a refrigerant flowing in the refrigerant circuit.

BACKGROUND

Known heat source units generally comprise an external housing accommodating at least the compressor, the heat source heat exchanger and an electric box accommodating electrical components configured to control the air conditioner, particularly the refrigerant circuit of the heat pump.

At least some of the electrical components contained in the electric box require cooling. For this purpose, JP 2016-191505 A discloses an electric box having an air passage comprising an air inlet and an air outlet opening into an interior of the external housing and a fan configured to induce an air flow through the air passage from the air inlet to the air outlet for cooling the electrical components.

The electrical components transfer heat to the air flowing in the air passage. The heated air is subsequently introduced into the interior of the external housing. A similar disclosure may be found in US 2016/0258636 A1.

To support cooling of the electrical components US 2016/0258636 A1 additionally suggests a heat dissipating plate disposed with a first portion in direct contact with an electrical component and with a second portion outside the electric box. A refrigerant piping connected to the refrigerant circuit is coupled to the second portion of the heat dissipating plate. It may for maintenance reasons or to make modifications of a controller contained in the electric box be required to access the electric box. In the configuration of US 2016/0258636 A1, the refrigerant piping has to be disassembled from the second portion of the heat dissipating plate. Due to the fragility of the refrigerant piping, there is a risk of damaging the refrigerant piping.

In addition, hot refrigerant components such as the compressor, a liquid receiver or an oil separator accommodated in the external housing of the heat source unit dissipate heat as well.

The heat source unit is under certain circumstances disposed in an installation environment or space, such as installation rooms inside a building. This is particularly the case when using water as the source of heat. Because the heat source unit as a whole dissipates heat, the temperature in the installation room may increase, which is perceived disadvantageous. If other equipment is also installed in the installation room and the other equipment is sensible to high temperatures, even additional cooling of the installation room may be required.

PATENT LITERATURE

[PTL 1] JP 2016-191505 A
[PTL 2] US 2016/0258636 A1

One or more embodiments of the present invention provide a heat source unit for an air conditioner and an air conditioner having such a heat source unit in which an amount of heat dissipated by the heat source unit can be reduced or even be eliminated.

SUMMARY

One or more embodiments of the present invention provide a cooling heat exchanger to be connected to the refrigerant circuit of the air conditioner and flown through by a refrigerant. The cooling heat exchanger is arranged so as to be flown through by the air flow induced through the air passage of the electric box, whereby the air is cooled. As a result, an amount of heat dissipated by the heat source unit, particularly the air expelled from the electric box after cooling the electrical components, can be reduced or even be eliminated. Yet, under certain circumstances, the cooling heat exchanger connected to the refrigerant circuit of the air conditioner may negatively affect the operating conditions of the air conditioner. Therefore, it is an aim to provide a heat source unit for an air conditioner and an air conditioner having such a heat source unit in which a cooling heat exchanger to cool the air flowing through the air passage of the electric box recovers the heat dissipated from the electrical components and uses the heat in the refrigerant circuit of the air conditioner. In this connection, it is beneficial if the cooling heat exchanger is arranged in the refrigerant circuit so as to enable heat recovery at the same time minimizing any negative effects on a possible capacity and operation of the air conditioner. Further, a simple control mechanism for controlling the refrigerant flow through the cooling heat exchanger is desired to minimize costs.

According to one or more embodiments, a heat source unit as defined in claim 1 is suggested. Further embodiments including an air conditioner having such a heat source unit are defined in the dependent claims, the following description and the drawings.

In accordance with one or more embodiments, a heat source unit for an air conditioner is suggested. In general, the air conditioner may be operated in a cooling operation for cooling a room (or a plurality of rooms) to be conditioned and optionally in heating operation for heating a room (or a plurality of rooms) to be conditioned. If the air conditioner is configured for more than one room even a mixed operation is conceivable in which one room to be conditioned is cooled whereas another room to be conditioned is heated. The suggested air conditioner comprises a refrigerant circuit. As previously indicated the refrigerant circuit may constitute a heat pump and comprise at least a compressor, a heat source heat exchanger, an expansion valve and at least one indoor heat exchanger. The heat source unit according to one or more embodiments comprises an external housing defining an interior of the heat source unit and an exterior of the heat source unit. The external housing accommodates at least the compressor, the heat source heat exchanger, an electric box and a cooling heat exchanger. The cooling heat exchanger may function as an evaporator in the refrigerant circuit and may, hence, also be referred to as an evaporator. The external housing may further accommodate an expansion valve, a liquid receiver, an oil separator and an accumulator of the refrigerant circuit. The components of the refrigerant circuit accommodated in the external housing, particularly the compressor and the heat source heat exchanger are to be connected to the refrigerant circuit. Further, the heat source heat exchanger is configured to exchange heat between a refrigerant circulating in the refrigerant circuit and a heat source, particularly water even though air and ground are as well conceivable. The electric box accommodates electrical components which are configured to control the air conditioner, particularly the heat pump. The electric box has at least a top and side walls. A bottom end of the electric box may either be open or has a bottom. The side walls extend in general along a vertical direction from the bottom to the top. "Along the vertical direction" in this context does not require that the side walls are oriented vertical even though this is one possibility. Rather, the side walls may also be inclined to the vertical direction. As long as the side walls are not angled more than 45° to a vertical direction, the side walls are to be understood as extending along the vertical direction. In order to enable cooling of at least some of the electrical components contained in the electric box, an air passage comprising an air inlet and an air outlet is suggested. According to one or more embodiments at least the air outlet is arranged in the electric box so as to open into the interior of the external housing. This is particularly preferred if also hot refrigerant components accommodated in the external housing are to be cooled as will be described later. Yet, it is also conceivable that the air outlet opens to the external of the external housing. The air inlet may either be arranged so as to open to the exterior of the external housing or into the interior of the external housing. An air flow through the air passage from the air inlet to the air outlet may be induced by natural convection. Alternatively, a fan may be provided either at the air inlet or the air outlet to induce the air flow as described later. A cooling heat exchanger to be connected to the refrigerant circuit of the air conditioner is suggested so as to minimize the amount of heat from the electrical components being dissipated into the surroundings of the heat source unit. The cooling heat exchanger may be arranged at one of the side walls of the electric box, e.g. at the air outlet of the air passage. In any case, the cooling heat exchanger is arranged so as to be flown through by the air flow and exchange heat between the refrigerant and the air flow. Further, the cooling heat exchanger is connected to a bypass line branched from a liquid refrigerant line, e.g. connected to the heat source heat exchanger, and a gas suction line, e.g. connected to a suction side of the compressor. "Liquid refrigerant line" is in this context to be understood as a line of the refrigerant circuit in which the flowing refrigerant is in the liquid phase. "Gas suction line" is in this context to be understood as a line of the refrigerant circuit on a suction side of the compressor in which gaseous refrigerant flows. According to an example, the liquid refrigerant line is a line connecting the heat source heat exchanger and the indoor heat exchanger. Furthermore, the bypass line may be connected to the liquid refrigerant line in this example with an expansion valve interposed between the bypass line and the heat source heat exchanger. In one particular example, the gas suction line may be a line connected to a suction side of the compressor with one or more components, such as an accumulator, that may be interposed. To put it differently, the cooling heat exchanger is connected to a bypass line branched from a liquid refrigerant line, e.g. connected to the heat source heat exchanger, and a gas suction line, e.g. connected to a suction side of the compressor. Yet, it is also conceivable that an accumulator is disposed between the connection of the bypass line to the gas suction line and the suction side of the compressor. The benefit of this aspect is that the cooling heat exchanger may always be operated as long as the compressor is operating so that a reliable system is obtained without negatively affecting the refrigerant circuit of the air conditioner. In addition, this arrangement provides for an efficient use of the heat dissipated from the electrical components in the refrigerant circuit during heating operation of the air conditioner.

Accordingly, in one case the air introduced through the air inlet may be cooled by heat transfer between the air and the refrigerant flowing through the bypass line and through the cooling heat exchanger, whereby the temperature of the refrigerant is increased and at least some of the refrigerant evaporates. Accordingly, the temperature of the air flowing into the air passage through the air inlet is lower than the temperature of the air in the interior of the external housing or the environment of the heat source unit. Thus, the air expelled through the air outlet may have a temperature similar to that of the air in the external housing or the environment of the heat source unit. As a result, the electrical components do not further heat up the interior of the external housing and the amount of heat dissipated to the exterior (environment) can be reduced.

If the cooling heat exchanger is disposed upstream of the electrical components in the air passage, it is conceivable that sweat is generated on the inside of the electric box because of the relatively cool air introduced into the air passage and the high temperature difference between the air passage and the electric box. To prevent the formation of sweat, the cooling heat exchanger may be disposed downstream of the electrical components to be cooled in the direction of the air flow. According to one or more embodiments, the cooling heat exchanger may be disposed at the air outlet of the air passage. Accordingly, the air flowing into the air inlet from the interior of the external housing flows through the air passage and cools the electrical components in the air passage, whereby the temperature of the air increases. Subsequently, the air is cooled by flowing through the cooling heat exchanger, wherein the temperature of the refrigerant flowing through the cooling heat exchanger is increased and the refrigerant evaporates. The air expelled from the air outlet of the cooling heat exchanger has a temperature which is at least similar if not the same as the temperature of air in the interior of the external housing and may even be lower. Hence, also in this case the electrical components do not further heat up the air in the interior of the external casing and hence heat dissipation to the exterior surroundings may be reduced. Furthermore, there is a risk that condensation water is formed on the surfaces of the cooling heat exchanger as explained earlier. Because the cooling heat exchanger is arranged downstream of electrical components of the electrical components and/or a heat sink heat conductively connected to electrical components of the electrical components which are disposed in the air flow, i.e. in the air passage, the risk is reduced that condensation water will come in contact with the electrical components or the heat sink. In particular, as the air flow is away from the electrical components and the heat sink in the air passage, the air flow will rather transport any condensation water away from the electrical components and the heat sink. Moreover, disposing the cooling heat exchanger downstream of the electrical components to be cooled has the advantage that a larger amount of heat may be transferred to the refrigerant so that heat recovery and the use of heat in the refrigerant circuit are improved.

In either case, the cooling of the air flowing through the air passage by the cooling heat exchanger may be called a zero heat dissipation control or operation (ZED).

Moreover, the bypass line has a valve upstream of the cooling heat exchanger and a controller is provided which controls the valve in an OFF-mode in which the valve is closed, e.g. completely closed, and an ON-mode in which the valve is opened, e.g. completely opened. As a consequence, it is possible to easily control and incorporate the cooling heat exchanger in the refrigerant circuit of the air conditioner. Being able to close the valve (OFF-mode), enables a control on the basis of the needs for cooling the air flowing through the air passage and a safety control preventing a negative effect on the air conditioner such as a lower capacity under high load operation or the risk of transporting liquid refrigerant from the liquid refrigerant line via the bypass line into the gas suction line during cooling operation.

The bypass line may have an expansion valve, wherein the opening degree of the expansion valve is controllable. Yet, according to an embodiment, the bypass line may have a valve and a capillary both upstream of the cooling heat exchanger. According to one embodiment, the valve is switched ON/OFF only, that is the valve is (completely) opened/closed only. The valve may be a solenoid valve. The use of a controlled expansion valve enables a more sophisticated control. Yet, this is not under all circumstances necessary with respect to the cooling heat exchanger flown through by the air flow. Thus, the use of a valve and a capillary instead of the expansion valve provides for a simpler configuration, which is less costly and can dispense the more complicated control logic necessary when using an expansion valve. In either case, it is possible to adapt the cooling performance of the cooling heat exchanger on the needs of the system and the circumstances such as operation conditions of the air conditioner.

In one particular embodiment, the controller is configured to allow manual setting of the OFF-mode. In other words, one can manually set in the controller that the valve is always closed and zero heat dissipation control may not be executed. This allows with one and the same system and under certain circumstances to not use the cooling heat exchanger for cooling the air in the air passage and thereby not affecting the capacity of the air conditioner. For example, if the heat source unit is disposed in a vented room, in which there is no necessity to maintain a stable temperature, the controller may be set to the OFF-mode.

Even further, the controller may be configured to switch between the OFF-mode and the ON-mode on the basis of operation conditions of the air conditioner. For example, the controller may be configured to switch the valve to the OFF-mode, if the air conditioner is operated in a cooling mode.

According to one or more embodiments, the controller is configured to switch the valve to the OFF-mode, when a required cooling capacity of the air conditioner exceeds a predetermined threshold. This operation may also be called "priority on the capacity". In cooling operation of the air conditioner, the cooling heat exchanger is also used to cool the air in the air passage and thus requires a proportion of the capacity of the air conditioner. In case the cooling demand of the rooms to be conditioned by the air conditioner is high (high load operation), the capacity of the air conditioner may not be sufficient to satisfy the cooling demand of the rooms and the cooling demand of the zero heat dissipation control. In this case, priority is given to the cooling demand of the rooms. Thus, if the cooling capacity required to satisfy the cooling demand of the rooms exceeds a predetermined threshold (predetermined cooling capacity), the valve is closed (OFF-mode) and the zero heat dissipation control is deactivated. For example, a heat source heat exchanger can transfer a certain amount of heat (further referred to as 100% heat load) to (in this example) water (water circuit) at certain operating conditions. During operation with deactivated ZED control, the heat source unit can remove heat from the room to be conditioned in correspondence with 100% heat load (cooling operation). Assuming that the heat loss from the electronic components and hot refrigerant components corresponds to 4% of the total heat load, only 96% of heat load (cooling capacity) can be used to cool the room during cooling operation. If the above setting is activated, the ZED control can be deactivated resulting in a 100% available capacity to cool the room. During heating operation of the room, the heat source heat exchanger will subtract 100% of heat from the water in the water circuit and deliver this heat, together with the 4% heat loss from the electric components, to the room. This results in a heating capacity of 104%, whereby the heating performance of the air conditioner is increased.

According to one or more embodiments, the controller is configured to switch the valve to the OFF-mode during special control modes of the air conditioner including the start-up of the air conditioner and oil return operations. Thus, it can surely be prevented that the zero heat dissipation control negatively affects the operation of the air conditioner during these special control modes. During start-up mode for example, the rotational speed of the compressor increases to nominal speed. At a low rotational speed, the circulated refrigerant amount is low. Yet, if the distance between the heat source unit and the indoor unit is large, the refrigerant in the liquid line connecting the heat source unit and the indoor unit has a relatively high inertia. In contrast, the bypass line is relatively short and has a low inertia. As a consequence, a higher proportion of the refrigerant flows through the bypass line, whereas a reduced amount or even no refrigerant may flow to the indoor unit. This may result in lower comfort in the room in which the indoor unit is mounted. This may be prevented by closing the valve. During oil return operation, a high mass flow rate is generated to flush oil out of the refrigerant circuit components. If the valve is open, the mass flow rate through the refrigerant circuit component was reduced resulting in a decreased oil return efficiency.

According to one or more embodiments, a first temperature sensor is accommodated within the external housing, wherein the controller is configured to switch between the ON-mode and the OFF-mode of the valve on the basis of a temperature measured by the first temperature sensor. Accordingly, it is possible to adapt the operation of the zero heat dissipation control to the actual amount of heat dissipated from the electrical component and/or other components within the external housing, such as hot refrigerant components including but not limited to the compressor, a liquid receiver and an oil separator. As a consequence, zero heat dissipation control is only activated (valve in ON-mode), if there is a need for cooling the interior of the external housing.

According to one example, a user can either freely input or select from a plurality of predetermined temperatures in the controller. Thus, the controller is able to compare the temperature measured by the first temperature sensor with the input or selected predetermined temperature. If the temperature measured by the first temperature sensor is higher than a predetermined temperature, the controller will switch to the ON-mode and open the valve. Thus, the air in the air passage is cooled by the cooling heat exchanger and the temperature within the external housing will be reduced. Additionally, it is conceivable that the user can either freely input or select from a plurality of differential temperatures in the controller. Hence, if the temperature measured by the first temperature sensor falls below the predetermined temperature minus the differential temperature, the controller may again switch to the OFF-mode by closing the valve. Thus, a relatively simple control can be obtained which is dependent on the cooling demand of the heat source unit to achieve zero heat dissipation or at least reduce heat dissipation of the heat source unit to a predetermined amount.

According to one or more embodiments, a third temperature sensor, preferably a thermistor, is disposed at an exit line between the cooling heat exchanger and a suction side of the compressor. In general, the exit line is to be understood as that line connecting the cooling heat exchanger to the gas suction line, i.e. between an exit of the cooling heat exchanger and the connection of the bypass line to the gas suction line. In one example, and as previously mentioned, an accumulator may be disposed between the cooling heat exchanger and the suction side of the compressor. In this case, the thermistor is disposed at an exit line between the cooling heat exchanger and a suction side of the accumulator disposed between the cooling heat exchanger and the compressor. The controller is configured to conclude on a superheat degree of the refrigerant in the exit line on the basis of the output of the thermistor. Particularly, the controller is configured to compare the temperature measured by the thermistor and a two-phase temperature of the refrigerant in the gas suction line. If the temperature measured by the thermistor is higher than the two-phase temperature, one may conclude that a high amount of superheated refrigerant is present in the exit line and vice versa. Preferably, one concludes on the two-phase temperature on the basis of a pressure measured by a pressure sensor disposed at the gas suction line. Further, the controller is configured to switch between the ON-mode and the OFF-mode of the valve on the basis of the superheat degree. During operation, the pressure difference between the liquid line and the gas suction line will depend on the operational conditions of the heat source unit. If there is a pressure drop in the bypass line, a refrigerant flow may be induced from the gas suction line into the bypass line. Depending on the air temperature in the external housing, the refrigerant flowing through the cooling heat exchanger and the thermal capacity of the air may be out of balance resulting in a fully evaporated refrigerant with a possible high superheat or a not fully evaporated refrigerant which contains liquid refrigerant. Those extreme situations may be avoided by opening/closing the valve (ON/OFF-mode) on the basis of the superheat degree obtained via the thermistor.

In one particular example, the controller is configured to switch to the OFF-mode, when the calculated superheat degree falls below a predetermined value for a predetermined period of time. The predetermined value and the predetermined period of time may be manually set in the controller (either freely input or selected from a number of given predetermined values and predetermined periods of time).

In order to ensure that the heat dissipated from the electrical components and/or hot refrigerant components within the external housing also in a case in which the zero heat dissipation control is deactivated (the valve is closed), the external housing has vents.

Further, according to one or more embodiments, the controller is accommodated in the electric box.

An air conditioner according to one or more embodiments may have a heat source unit according to one or more embodiments described above. The heat source unit is connected to at least one indoor unit having an indoor heat exchanger forming the refrigerant circuit. As previously indicated, the air conditioner has the refrigerant circuit which may constitute a heat pump. Hence, the refrigerant circuit may comprise the compressor, the heat source heat exchanger, an expansion valve and at least one indoor heat exchanger to form a heat pump circuit. Additional components as known for air conditioners may be included as well such as a liquid receiver, an accumulator and an oil separator. According to one or more embodiments, the air conditioner uses water as a heat source. According to one or more embodiments, the air conditioner is mounted in a building comprising one or more rooms to be conditioned and the heat source unit is installed in an installation environment or space, such as an installation room of the building.

In particular, if the heat source unit is installed in a room (installation room) and if the room is insulated and not very well ventilated, there is a risk that the temperature in the room increases because of the heat dissipated by the heat source unit.

According to one or more embodiments, the air conditioner further comprises a second temperature sensor detecting a temperature in the installation environment or space, particularly the installation room.

In one example, the controller is configured to switch to the ON-mode, when the temperature measured by the first temperature sensor is higher than the temperature measured by the second temperature sensor. This enables to activate/deactivate the zero heat dissipation control in dependency of a temperature difference between the interior of the external housing and the installation environment. Only in cases in which the heat source unit tends to heat up the installation environment (the temperature measured by the first temperature sensor is higher than the temperature measured by the second temperature sensor), the valve is controlled to the ON-mode. Otherwise, the valve is controlled to the OFF-mode.

In another example, one defines another (second) predetermined temperature, a so-called no-environment (e.g. room)-impact-temperature. This may either be achieved by freely inputting the no-environment-impact-temperature into the control or selecting from a number of given no-environment-impact-temperatures as explained above. In this case, the controller is configured to switch to the ON-mode depending on a delta between the temperature measured by the second temperature sensor and the predetermined temperature (no-environment-impact-temperature). In particular, if the temperature measured by the second temperature sensor exceeds the no-environment-impact-temperature by a certain differential temperature (delta), the valve is opened (ON-mode). Also in this case, the differential temperature (second differential temperature) may be freely input into the controller or selected from a number of given differential temperatures. According to one example and if the temperature measured by the second temperature sensor falls below the no-environment-impact-temperature, the control is configured to switch to the OFF-mode closing the valve.

According to one or more embodiments, the controller may be configured to switch to the ON-mode when a difference $Q_H$ between a first heat transfer capacity $Q_1$ of the air conditioner at an indoor unit side and a second heat transfer capacity $Q_2$ of the air conditioner at an indoor unit side is higher than the heat transfer capacity $Q_3$ of the cooling heat exchanger and to the OFF-mode when a difference $Q_H$ between the first heat transfer capacity $Q_1$ of the air conditioner and the second heat transfer capacity $Q_2$ of the air conditioner is lower than the heat transfer capacity $Q_3$ of the cooling heat exchanger, wherein the first heat transfer capacity $Q_1$ of the air conditioner is a heat transfer capacity during a first operation mode in which the compressor is driven at a first frequency. The first operation mode may be a normal operation mode in which the compressor is driven at a variable frequency depending on the thermal load on the indoor unit side. That is, when the thermal load increases, the compressor frequency increases and if the thermal load drops, the compressor frequency decreases. The second heat transfer capacity $Q_2$ of the air conditioner is a capacity during a second operation mode in which the compressor is driven at a second frequency lower than the first frequency depending on specific operational conditions of the air conditioner. For example, the compressor frequency is decreased to a second frequency, when a parameter of the input current (such as the temperature of an inverter) of the compressor is equal to or higher than a predetermined value in order to protect the compressor from being damaged.

The first operation mode of the air conditioner is considered as an operation mode before a reduced frequency mode (second operation mode) is triggered by any operation condition such as that named above. Thus, the first frequency is the frequency of the compressor immediately before a specific operational condition has been detected, which would usually trigger a reduction in frequency (second operation mode). On the other hand, the heat transfer capacity during the operation condition is either the actual heat transfer capacity of the system, if the frequency is immediately reduced, or a theoretical heat transfer capacity on the basis of a reduced frequency which the system would assume, if considered necessary, on the basis of further parameters.

When the temperature of an inverter as one of the electrical components exceeds a certain value, it usually becomes necessary to reduce the frequency of the compressor which directly influences the inverter temperature. However, reducing the frequency reduces the available system capacity of the air conditioner. In one or more embodiments, it is, however, possible to quickly cool the inverter and, hence, return to normal operation (first operation mode) and full capacity in a short period of time by using the cooling heat exchanger and starting the zero heat dissipation control. In another implementation, it may even be possible to avoid the necessity to reduce the compressor frequency by using the cooling heat exchanger and starting the zero heat dissipation control. In either case, discomfort due to a reduced air conditioning capacity may be reduced or even be avoided.

Further aspects, features and advantages may be found in the following description of particular examples. This description refers to the accompanying drawings.

BRIEF DESCRIPTION OF THE DRAWINGS

FIG. 1 shows an example of an air conditioner installed in an office building.

FIG. 2 shows a schematic circuit diagram of a simplified air conditioner.

FIG. 3 shows a schematic side view of a heat source unit with the side walls and the top of the external housing being removed.

FIG. 4 shows an overall perspective view of a heat source unit.

FIG. 5 shows a perspective view of the heat source unit of FIG. 4 with a maintenance plate of the external housing being removed.

FIG. 6 shows a side view of the heat source unit of FIG. 4 with the side walls and the top of the external housing being removed.

FIG. 7 shows a perspective view of the heat source unit of FIG. 4 with the side walls and the top of the external housing being removed.

FIG. 8 shows a top view of the heat source unit of FIG. 4 with the side walls and the top of the external housing being removed.

FIG. 9 shows a perspective view of the heat source unit of FIG. 4 with the side walls and the top of the external housing and the electric box being removed.

FIG. 10 shows a graph showing a control mechanism according to an example.

FIG. 11 shows a flow chart showing a method for controlling the opening/closing of the valve on the basis of a comparison between a difference $Q_H$ between a first heat transfer capacity $Q_1$ of the air conditioner at an indoor unit side and a second heat transfer capacity $Q_2$ of the air conditioner at an indoor unit side and the heat transfer capacity of the cooling heat exchanger.

FIG. 12 shows a flow chart showing a modification of the method of FIG. 11.

FIG. 13 shows a schematic side view of an inverter mounted on the heat sink.

FIG. 14 shows a p-h graph (Mollier diagram) of the refrigeration cycle

DETAILED DESCRIPTION

In the following description and the drawings, the same reference numerals have been used for the same elements and repetition of the description of these elements in the different embodiments is omitted.

FIG. 1 shows an example of an air conditioner 1 installed in an office building. The office building has a plurality of rooms 105 to be conditioned such as conference rooms, a reception area and working places of the employees.

The air conditioner 1 comprises a plurality of indoor units 100 to 102. The indoor units are disposed in the rooms 105 and may have different configurations, such as wall-mounted 102, ceiling mounted 101 or duct-type indoor units 100.

The air conditioner further comprises a plurality of heat source units 2. The heat source units 2 are installed in an installation room 29 of the office building. Other equipment such as servers (not shown) may be installed in the installation room 29 as well. In the present example, the heat source units 2 use water as heat source. In the particular example, a water circuit 104 is provided which is connected to a boiler, dry-cooler, cooling tower, ground loop or the like. The water circuit 104 may as well have a heat pump circuit including a refrigerant circuit. An outdoor unit comprising the heat source heat exchanger of this heat pump circuit may be disposed on the roof of the office building and use air as the heat source. Yet, the concept of the heat source unit of the present disclosure is also applicable to other heat sources such as air or ground.

In operation, one or more of the indoor units 100 to 102 may be operated to cool the respective rooms 105 whereas others are operated to heat the respective rooms.

A simplified schematic diagram of the air conditioner is shown in FIG. 2. The air conditioner 1 in FIG. 2 is mainly constituted by an indoor unit 100 and the heat source unit 2. Yet, the air conditioner 1 in FIG. 2 may also have a plurality of indoor units 100. The indoor units may have any configuration such as those described with respect to FIG. 1 above.

Further, FIG. 2 shows the refrigerant circuit constituting a heat pump. The refrigerant circuit comprises a compressor 3, a 4-way valve 4 for switching between cooling and heating operation, a heat source heat exchanger 5, an expansion valve 6, and optional additional expansion valve 7 and an indoor heat exchanger 103. The heat source heat exchanger 5 is additionally connected to the water circuit 104 as the heat source. When the compressor 3 is operated, a refrigerant is circulated in the refrigerant circuit.

In cooling operation, high-pressure refrigerant is discharged from the compressor 3, flows through the 4-way valve 4 to the heat source heat exchanger 5 functioning as a condenser whereby the refrigerant temperature is decreased and gaseous refrigerant condensed. Thus, heat is transferred from the refrigerant to the water in the water circuit 104. Subsequently, the refrigerant passes the expansion valve 6 and the optional expansion valve 7, wherein the refrigerant is expanded before being introduced into the indoor heat exchanger 103 functioning as an evaporator. In the indoor heat exchanger 103, the refrigerant is evaporated and heat is extracted from the air in the room 105 to be conditioned, whereby the air is cooled and reintroduced into the room 105. At the same time, the temperature of the refrigerant is increased. Subsequently, the refrigerant passes the 4-way valve 4 and is introduced into the compressor 3 as low-pressure gaseous refrigerant at the suction side of the compressor 3. In view of the aforesaid, the line connecting the heat source heat exchanger 5 and the indoor heat exchanger 103 is considered a liquid refrigerant line 25. The line connecting the 4-way valve 4 and the suction side of the compressor 3 is considered a gas suction line 26.

In heating operation, high-pressure refrigerant is discharged from the compressor 3, flows through the 4-way valve 4 to the indoor heat exchanger 103 (dotted line of the 4-way valve 4) functioning as the condenser, whereby the refrigerant temperature is decreased and gaseous refrigerant condensed. Thus, heat is transferred from the refrigerant to the air in the room 105 whereby the room is heated. Subsequently, the refrigerant passes the optional expansion valve 7 and the expansion valve 6, wherein the refrigerant is expanded before being introduced into the heat source heat exchanger 5 functioning as an evaporator via the liquid refrigerant line 25. In the heat source heat exchanger 5, the refrigerant is evaporated and heat is extracted from water in the water circuit 104. At the same time, the temperature of the refrigerant is increased. Subsequently, the refrigerant passes the 4-way valve 4 (dotted line of the 4-way valve 4) and is introduced into the compressor 3 as low-pressure gaseous refrigerant at the suction side of the compressor 3 via the gas suction line 26.

The refrigerant circuit shown in FIG. 2 further comprises a bypass line 24 branched from the liquid refrigerant line 25 and connected to the gas suction line 26. In the particular example, the bypass line 24 is connected to the liquid refrigerant line 25 between the expansion valve 6 and the indoor heat exchanger 103. If the optional expansion valve 7 is provided, the bypass line 24 is connected between the expansion valve 6 and the optional expansion valve 7.

The bypass line 24 comprises a valve 20 which may assume an open and a closed position (ON/OFF). The valve 20 may be a solenoid valve. Furthermore, the bypass line 24 comprises a capillary 21. In the particular example, the capillary 21 is disposed downstream of the valve 20 in the direction of the flow of refrigerant during cooling operation. Yet, the valve 20 may as well be disposed downstream of the capillary 21.

Furthermore, a cooling heat exchanger 22 (described in more detail below) is connected to the bypass line 24 downstream of the capillary 21 and the valve 20 in the direction of flow of refrigerant during cooling operation. The function of this cooling heat exchanger 22, the valve 20 and the capillary 21 will be described further below.

In one example, the components contained in the dotted rectangle indicating the heat source unit 2 in FIG. 2 are accommodated in an external housing 10 (see FIG. 4) of the heat source unit 2.

As schematically indicated in FIG. 3 and shown in more detail in FIGS. 4 to 9, the external housing 10 has side walls 15 and a top 13 both shown in a dotted line. Furthermore, the external housing 10 has a bottom 14. Thus, the external housing 10 defines an interior 12 of the external housing 10 and an exterior 11 of the external housing 10 which in one example may be the installation room 29 as an example of an installation environment or installation space (see FIG. 1). In the present example, the bottom 14 has a drain pan 16 for collecting any condensation water accumulated in the external housing 10. The bottom 14 supports the remaining components of the heat source unit 2 to be explained in the following. According to one example, none of the components contained in the external housing 10 is fixed to the side walls 15 or the top 13, but all components are directly or indirectly, via the support structures, fixed to the bottom 14.

As an example, the compressor 3, and a liquid receiver 8 commonly used in refrigerant circuits of air conditioners are shown as a components accommodated in the external housing 10. Further components are an oil separator 9 and an accumulator 108 (see FIG. 7). In this context, the compressor 3, the liquid receiver 8 and the oil separator 9 are considered as hot refrigerant components, because at least a proportion of the refrigerant passing through these components is gaseous and hot. The accumulator 108 in contrast is considered as a cold refrigerant component as only low pressure refrigerant passes through the accumulator 108.

The external housing 10 may have vents 17 to allow ventilation of the interior 12 in case the later described zero heat dissipation control is not active.

Furthermore, the heat source unit 2 comprises an electric box 30. The electric box 30 has the shape of a parallelepiped casing, but other shapes are conceivable as well. In the example, the electric box 30 has a top 31, the side walls (in the present example four side walls, namely a back 32, a front 33 and two opposite sides 34) and a bottom 35. In other embodiments, the bottom may be open. The electric box 30 has a height between the bottom end 35 and the top 31, a depth between the back 32 and the front 33 and a width between the two opposite sides 34. In the present embodiment, the electric box 30 is longitudinal having a height larger (at least twice as large) than the depth and the width.

The electric box 30 accommodates a plurality of electrical components 36 configured to control the air conditioner and particularly its components such as the compressor 3, the expansion valves 6 and 7 or the valve 20. The electrical components 36 are schematically shown in FIG. 3 only.

The electric box 30 further defines an air passage 37 having an air inlet 38 and an air outlet 39. In the present embodiment, the air inlet 38 is disposed closer to the bottom 35 or the bottom end of the electric box 30 than the air outlet 39. Even more particular, the air outlet 39 is located adjacent to the top 31 of the electric box 30. Due to the longitudinal configuration of the electric box 30 and it is orientation with respect to the longitudinal extension along a vertical direction, the air outlet 39 is located adjacent to a top 13 of the external housing 10 (closer to the top 13 than to the bottom 14). In addition, both the air inlet 38 and the air outlet 39 open into the interior 12 of the external housing 10.

The electrical components 36, which require cooling, are either directly disposed in the air passage 37 as shown in FIG. 3 and/or a heat sink is provided which is heat conductively connected to electrical components to be cooled and the heat sink is directly disposed in the air passage 37.

Furthermore, the present embodiment shows a fan 40 to induce an air flow 41 (arrows in FIG. 3) from the air inlet 38 to the air outlet 39 through the air passage 37. Accordingly, the air passes the electrical components 36 for cooling, wherein heat is transferred from the electrical components either directly or via the mentioned heat sink to the air flowing through the air passage 37. Certainly, also more than one fan 40 may be provided.

In the present embodiment, the fan 40 is arranged at the air outlet 39 of the air passage so that air from the interior 12 of the external housing 10 is sucked into the air inlet 38 passes through the air passage 37 and is expelled to the interior 12 of the external housing adjacent to the top 13 of the external housing 10. Accordingly, natural convection is assisted in that relatively cool air is expelled at the top and will naturally flow down towards the bottom 14.

Furthermore and as shown in FIGS. 3, and 6 to 9, the cooling heat exchanger 22 is arranged downstream of the electrical components 36 as seen in the direction of the air flow 41. In the particular example, the cooling heat exchanger 22 is also disposed at the air outlet 39 of the air passage 37 and even downstream of the fan 40 in the direction of the air flow 41. In one example, the cooling heat exchanger 22 is attached to the air outlet 39 via a duct 23. The duct 23 forms an air passage between the air outlet 39 of the air passage 37 and an air inlet 27 of the cooling heat exchanger 22. The duct 23 can be used to change the direction of the air flow 41 and/or to mount a commonly known parallelepiped heat exchanger has the cooling heat exchanger 22 in an angled fashion as will be described later.

As may be best seen in FIG. 7, the cooling heat exchanger 22 has a plurality of tubes 43 curved at end portions of the cooling heat exchanger 22 and passing a plurality of fins 42 schematically indicated in FIG. 7. The fins 42 are longitudinal, plate shaped and extend with their longitudinal extension along a vertical direction, i.e. between the bottom 14 and the top 13. It is to be understood, that extending along a vertical direction is as long realized as a longitudinal centerline of the fins 42 in a side view as in FIG. 3 does not intersect a vertical line at an angle of more than 45°. The fins 42 are flat and have a longitudinal extension (lengths) and widths much larger than the height, whereby a main surface of the fins 42 is defined by the length and the width.

In the particular example, the cooling heat exchanger 22, and particularly the longitudinal direction of the fins 42, is angled by an angle $\alpha$ (see FIG. 3) relative to the vertical direction. Accordingly, an air outlet 28 of the cooling heat exchanger is oriented such that the air flow 41 is directed toward hot refrigerant components, in the present example the compressor 3, the liquid receiver 8 as well as an oil separator 9 (see FIG. 8). The angle $\alpha$ may be in a range between 0° and 25°. As a result, the air cooled by the cooling heat exchanger 22 and expelled from the air outlet 28 of the cooling heat exchanger 22 is also used to cool one or more of the hot refrigerant components. Consequently, the amount of heat dissipated by the heat source unit 2 as such can be reduced.

Moreover, the cooling heat exchanger 22 has a bottom end portion 44 such as a bottom plate. In the present embodiment, the bottom end portion 44 is downwardly inclined from the air inlet 27 of the cooling heat exchanger 22 towards the air outlet 28 of the cooling heat exchanger 22. In other words, the bottom end portion 44 slopes downward towards a bottom 14 of the external housing 10.

As indicated in the introductory portion, there is a risk that condensation water forms on the cooling heat exchanger 22 because of the humidity in the air in the interior 12 of the external housing 10 and the temperature difference. Yet, the particular example provides several means for guiding any condensation water away from the air outlet 39 of the air passage 37 so as to prevent any water from coming into contact with the electrical components 36 or the heat sink in the air passage 37.

On the one hand and as mentioned above, the fins 42 are oriented with their longitudinal direction along a vertical direction. Accordingly, any condensation water formed on the main surfaces of the fins 42 flows down along the fins 42 and, hence, in a vertical direction due to gravity. On the other hand, the bottom end portion 44 of the cooling heat exchanger 22 is downwardly inclined. Accordingly, any condensation water which has flown down the fins 42 and reaches the bottom end portion 44 is guided by the bottom end portion 44 to the air outlet 28 of the cooling heat exchanger 22. At a front edge of the air outlet 28 of the cooling heat exchanger 22, the condensation water may drop down into the drain pan 16 in the bottom 14 of the external housing 10. Thus, any condensation water is securely guided away from the air outlet 39 of the air passage 37.

In addition and as previously mentioned, the cooling heat exchanger 22 is arranged at the air outlet 39 of the air passage 37 and consequently downstream of the electrical components 36 or the heat sink disposed in the air passage 37 in the direction of the air flow 41. Accordingly, the air flow 41 "blows" any condensation water formed on the cooling heat exchanger 22 in a direction away from the air outlet 39 and the electrical components 36. This configuration also assists preventing condensation water from coming into contact with sensible parts of the electric box 30.

Even further, the fan 40 is disposed between the cooling heat exchanger 22 and to the electrical components 36 in the air passage 37. Accordingly, the fan 40 can be considered as a partition separating the cooling heat exchanger 22 from the air passage 37. Hence, the fan 40 is an additional barrier for condensation water and prevents the condensation water from entering the air passage 37.

The electric box 30 is, in the present embodiment, supported so as to be rotatable about an axis of rotation 46. The support structure 45 is shown in more detail in FIGS. 6 to 9. Thus, the electric box 30 is hinged to the support structure 45 so as to be movable between a use position shown in FIG. 3 and a maintenance position in which the electric box 30 is tilted about the axis of rotation 46 in a counterclockwise direction shown by the arrow in FIGS. 3 and 6. The axis of rotation 46 is located at a first end of the electric box close to the bottom 35, i.e. opposite to the top 31. Furthermore, the electric box 30 is at the top 31 releasably fixed to the support structure to retain the electric box 30 in the use position by bolts 57 (see FIG. 5).

In the embodiment shown in FIGS. 6 to 9, the support structure 45 (best visible from FIG. 9) is formed by a frame 47. The frame 47 is fixed to the bottom 14 of the external housing 10. The frame 47 has two upright columns 48. The columns 48 are mounted to the bottom 14 of the external housing 10.

Each of the columns 48 has at its bottom end close to the bottom 14 of the external housing 10 a slot 49. A boss 50 is provided on either side 34 of the electric box 30 and engaged with one of the slots 49. Different to the schematic view in FIG. 3, the detailed representation of the slot 49 in FIGS. 6 and 7 shows an inserting portion 51 used to insert the boss 50 into the slot 49 or to remove the boss 50 from the slot 49 and, hence, to completely remove the electric box 30 from the heat source unit 2. The inserting portion 51 has an opening 52 at one end for introducing the boss 50. Furthermore, an engagement portion 53 is formed at the opposite end of the inserting portion 51. The engagement portion has a lower section 54 supporting the boss 50 in the use position in an upward direction and an upper section 55 supporting the boss 50 in the maintenance position in a downward direction. The axis of rotation 46 is formed by the bosses 50. It is also clear from the side view of FIG. 6, that the center of gravity 56 of the electric box 30 is arranged so that the electric box 30 tends to rotate about the axis of rotation 46 in a clockwise direction that is towards the interior 12 of the external housing 10.

As previously mentioned, the electric box 30 may be releasably fixed to the frame 47 by bolts 57 (see FIG. 5). When releasing the bolts 57 at the upper end near the top 31 of the electric box 30 from the frame 47, the electric box may be rotated about the axis of rotation 46 or the bosses 50, respectively, in a counterclockwise direction as will be explained in more detail below. For rotating the electric box 30 it is conceivable to provide a handle 64 (see FIG. 5) in or at an outer surface of the electric box 30.

The cooling heat exchanger 22 is in the present example together with the duct 23 fixed to the frame 47 by bolts. As may be best seen from FIG. 9, the air outlet 39 or more particularly an opening 59 of the frame 47 facing the air outlet 39 of the air passage 37 is surrounded by an elastic sealing 60. The elastic sealing 60 is as well fixed to the frame 47. The sealing, particularly the contact surface of the sealing facing the electric box 30 defines a plane 61. The center of gravity 56 is in a side view (FIG. 6) disposed between the plane 61 and the axis of rotation 46 (formed by the boss 50). Thus, the electric box 30 tends to rotate against the contact surface of the sealing 60 by gravity ensuring a proper contact with the sealing at the air outlet 39 between the outlet 39 and the cooling heat exchanger 22 and its optional duct 23. Certainly, other or further possibilities to seal between the outlet 39 and the cooling heat exchanger 22 and its optional duct 23 are conceivable. For example, the sealing could also be established by correct dimensioning and adding sufficient fixation points between the mating surfaces. Moreover, a separate clamping element may be used to press the mating surfaces together.

The electrical components 36 in the electric box 30 need to be connected to some of the components of the refrigerant circuit contained in the external housing 10. For this purpose, the electric box 30 has either an open bottom or an opening is provided in the bottom 35. A first electric wire 62 connected to a first electric component in the electric box 30 leaves the electric box through the bottom end of the electric box 30 and is connected to the first electric component such as the solenoid valve 20 (see FIG. 2 and FIG. 8). For this purpose, the electric wire 62 schematically indicated in FIG. 3 is guided from the bottom 35 to the bottom 14 of the external housing 10, along the bottom 14 and from the bottom 14 to the first electric component (in the example the valve 20).

Under some circumstances and for EMC (electromagnetic compatibility) reasons, some electric wires need to be separated from other electric wires. Accordingly, it is conceivable that a second electric wire 63 leaves the electric box 30 through an opening 70 (see FIG. 7) between the bottom 35 and the top 31 of the electric box 30. Also, the second electric wire 63 is guided to the bottom 14 of the external housing 10 and from the bottom to the component such as the compressor 3. Neither the first electric wire 62 nor the second electric wire 63 is fixed to the bottom 14 of the external housing 10 in the example.

In the case that maintenance of electric components 36 or refrigerant components or the fan 40 of the electric box 30 is required, one has to remove a maintenance wall 106 of the external housing 10 (see FIG. 4). For this purpose, the bolts 107 are removed and subsequently the maintenance wall 106 can be removed as shown in FIG. 5. Once the maintenance wall 106 has been removed, one can loosen the bolts 57 at the top end of the electric box 30 (FIG. 5) and pivot the electric box 30 about the axis of rotation 46, formed by the bosses 50, out through the opening created by removing the maintenance wall 106. During this process, the boss 50 moves from the lower section 54 of the engagement portion 53 of the slot 49 into the upper section 55 of the engagement portion 53 of the slot 49. Accordingly, the electric box 30 is reliably held in the slot 49 and can easily be pivoted.

As will be apparent from the above description, the electric box 30 and the cooling heat exchanger 22 are independently fixed to the support structure 45 (the frame 47). There is no attachment of the electric box 30 to the cooling heat exchanger 22. Accordingly, moving the electric box 30 into the maintenance position (not shown) does not affect the cooling heat exchanger 22 and its refrigerant piping 24. The cooling heat exchanger 22, the duct 23 (if present) and the sealing 60 remain mounted in their position on the frame 47 and are not moved together with the electric box 30. In this context, the fan 40 may as well be fixed to the electric box 30 and may be pivoted into the maintenance position together with the electric box 30 to enable easy maintenance or substitution of a damaged fan 40.

When the electric box 30 is moved into the maintenance position, the first electric wire 62 guided through the bottom 35 of the electric box 30 moves towards the inner side of the external housing 10 and, therefore, in a direction toward the electrical component 20 to which it is connected. Accordingly, no strain is applied to the first electric wire 62 by moving the electric box 30 into the maintenance position.

The second electric wire 63 leaving the electric box through the opening 70 is first guided to the bottom 13 of the external housing 10. Thus, there is a certain free length of the second electric wire 63 between the opening 70 and the connection to the compressor 3. Thus, also in this case strain on the second electric wire 63 can be avoided when moving the electric box 30 into the maintenance position.

The above configuration enables easy access to the electric box and does not require any disassembly/assembly work on the cooling heat exchanger 22 and its refrigerant piping 24. For this reason, damages to the cooling heat exchanger 22 and its refrigerant piping 24 can be prevented.

After the maintenance, the electric box 30 is pivoted about the axis of rotation 46 (bosses 50) in an opposite direction (clockwise in FIGS. 3 and 6) into the use position shown in the drawings. During this process, the boss 50 again moves back to the lower section 54 of the engagement portion 53 of the slot 49 so that the electric box 30 is securely supported in a vertical direction. Because the center of gravity 56 is closer to a plane 61 formed by the contact surface of the sealing 60 than to the axis of rotation 46 (bosses 50) in a side view, the weight of the electric box 30 ensures that the electric box 30 is securely pressed against the contact surface of the sealing 60 and does even without the bolts 57 not "drop" out of the maintenance opening. Subsequently, the bolts 57 are reinserted and the maintenance wall 106 is reinstalled.

Further, a controller 65 is provided which is schematically shown in FIG. 2. The controller 65 has the purpose of controlling the air conditioner 1 and particularly the refrigerant circuit. The controller 65 may be accommodated in the electric box 30.

The controller 65 may be configured to control the air conditioner 1 on the basis of parameters obtained from different sensors.

For example, a first temperature sensor 66 is disposed in the interior 12 of the external housing 10. Thus, the first temperature sensor 66 detects the temperature in the interior 12 of the external housing 10. In this context, the position of the first temperature sensor 66 is determined relative to the position of the other components in the external casing at a position in which a relatively stable and representative temperature can be measured. Thus, this position has to be determined by experiments.

A second temperature sensor 67 may be arranged in the installation room 29 in which the heat source unit 2 is installed. The second temperature sensor 67, hence, measures a temperature in the installation room 29 in other words the temperature of the environment (exterior) of the external housing 10.

Another parameter used by the controller 65 is a thermistor 68 (third temperature sensor) at an exit line 69 between the cooling heat exchanger 22 and a suction side of the compressor 3 (see FIG. 2). In one embodiment, it is conceivable that an accumulator 108 is disposed in the line between the cooling heat exchanger 22 and the inlet of the compressor 3 (suction side). In general, the exit line 69 is to be understood as that line connecting the cooling heat exchanger 22 to the gas suction line 26, i.e. between an exit of the cooling heat exchanger 22 and the connection of the bypass line 24 to the gas suction line 26. The thermistor 68 measures the temperature of the refrigerant in the exit line 69. Further, a pressure sensor 71 is provided and configured to measure the pressure of the refrigerant in the gas suction line 26.

The operation of the air conditioner with respect to the cooling heat exchanger 22 is described in more detail below. This operation may also be referred to as the zero heat dissipation control (ZED=zero energy dissipation).

In principle, one can choose between three settings explained in more detail and shown in the table below.

| Setting | 0 | 1 | 2 |
|---|---|---|---|
| Zero heat dissipation control | OFF | ON priority on cooling capacity | ON priority on zero heat dissipation |

In setting "0", the valve 20 is completely closed and no refrigerant flows through the cooling heat exchanger 22. In this setting, the electric components 36 may still be cooled by operating the fan but the heat is dissipated to the interior 12 of the external casing 10, and hence the external casing 10 and the heat source unit 2 dissipate heat to the installation room 29. The zero heat dissipation control is switched OFF.

If setting "1" is selected, zero heat dissipation control is ON. Yet, in this setting, the cooling capacity of the air conditioner has priority over the zero heat dissipation control. In particular, if a temperature measured in a room 105 to be conditioned exceeds a set temperature of the air conditioner in that room 105 by a certain value, and the air conditioner can only satisfy this additional cooling demand if the zero heat dissipation control is deactivated, the valve 20 will be closed. To put it differently, the valve 20 is closed, when a required cooling capacity of the air conditioner exceeds a predetermined threshold. For example, a heat source heat exchanger 5 can transfer a certain amount of heat (further referred to as 100% heat load) to (in this example) water (water circuit 104) at certain operating conditions. During operation with deactivated ZED control, the heat source unit 4 can remove heat from the room (105) in correspondence with 100% heat load (cooling operation). Assuming that the heat loss from the electronic components and hot refrigerant components corresponds to 4% of the total heat load, only 96% of heat load (cooling capacity) can be used to cool the room 105 during cooling operation. If the above setting is activated, the ZED control can be deactivated resulting in a 100% available capacity to cool the room 105. During heating operation of the room 105, the heat source heat exchanger 5 will subtract 100% of heat from the water in the water circuit 104 and deliver this heat, together with the 4% heat loss from the electric components 36, to the room 105. This results in a heating capacity of 104%, whereby the heating performance of the air conditioner 1 is increased.

If setting "2" is selected, zero heat dissipation control is ON independent of the cooling capacity of the air conditioner. However, under certain special control operations, such as start-up and oil return, zero heat dissipation control is still deactivated (the valve 20 is closed) in order to avoid damaging of the compressor 3 due to liquid refrigerant flowing back into the compressor 3. During start-up mode for example, the rotational speed of the compressor increases to nominal speed. At a low rotational speed, the circulated refrigerant amount is low. Yet, if the distance between the heat source unit 2 and the indoor unit 100 is large, the refrigerant in the liquid line connecting the heat source unit 2 and the indoor unit 100 has a relatively high inertia. In contrast, the bypass line 24 is relatively short and has a low inertia. As a consequence, a higher proportion of the refrigerant flows through the bypass line 24, whereas a reduced amount or even no refrigerant may flow to the indoor unit 100. This may result in lower comfort in the room 105 in which the indoor unit 100 is mounted. This may be prevented by closing the valve 20. During oil return operation, a high mass flow rate is generated to flush oil out of the refrigerant circuit components. If the valve 20 is open, the mass flow rate through the refrigerant circuit component was reduced resulting in a decreased oil return efficiency.

In either case, the zero heat dissipation control may be performed on the basis of different parameters.

According to a first possibility, the temperature of the interior 12 of the external casing 10 is measured by the first temperature sensor 66 and the controller 65 controls the valve 20 on the basis of the temperature measured by the first temperature sensor 66.

In particular, the controller 65 compares the temperature measured by the first temperature sensor 66 with a predetermined temperature. In this embodiment, it is preferred that one either freely inputs the predetermined temperature or can select from different settings as shown in the table below to define the predetermined temperature.

| | Setting | | | | | | | |
|---|---|---|---|---|---|---|---|---|
| | 0 | 1 | 2 | 3 | 4 | 5 | 6 | 7 |
| Predetermined temperature [° C.] | 25 | 27 | 29 | 31 | 33 | 35 | 37 | 39 |

Further, one either freely inputs a differential temperature or again selects the differential temperature from different settings as shown in the table below to define the differential temperature.

| Setting | 0 | 1 | 2 | 3 |
|---|---|---|---|---|
| Differential temperature [° C.] | 3 | 2 | 1 | 5 |

According to this control, the controller 65 compares the temperature measured by the first temperature sensor 66 with the predetermined temperature. If the temperature measured by the first temperature sensor 66 exceeds the predetermined temperature, the controller 65 is configured to activate the zero heat dissipation control and open the valve 20 (completely).

Then again and as shown in FIG. 10, if the temperature measured by the first temperature sensor 66 falls below the predetermined temperature minus the selected differential temperature, the controller 65 is configured to deactivate the zero heat dissipation control and close the valve 20 (completely).

For example, if the setting "3" is selected for the predetermined temperature, the predetermined temperature is 31° C. Further, if the setting "0" is selected for the differential temperature, the differential temperature is 3° C. If for example the temperature measured by the first temperature sensor 66 in the interior 12 of the external housing 10 exceeds 31° C., the valve 20 is opened by the controller 65. Accordingly, the refrigerant flows through the capillary 21, is expanded and then flows into the cooling heat exchanger 22. In the cooling heat exchanger, the refrigerant extracts heat from the air flow 41 by heat exchange, whereby the air flow 41 is cooled and cooled air is expelled into the interior 12 of the external housing 10. Thereby also the hot refrigerant components such as the compressor 3, the liquid receiver 8 and the oil separator 9 are cooled, because of the orientation of the air outlet 28 of the cooling heat exchanger 22 in an angled fashion. In particular, the cooled air flow 41 is directed in a direction of the hot refrigerant components which are accordingly cooled. In any case, air that is cooler than the air in the interior 12 of the external housing 10 is expelled from the cooling heat exchanger 22 into the interior 12. As a result, the temperature decreases in the external housing 10. Once the temperature measured by the first temperature sensor 66 falls below 28° C. (31° C.-3° C.), the controller 65 closes the valve 20 and no refrigerant flows through the cooling heat exchanger 22. This process is repeated as shown in FIG. 10.

Alternatively or in addition to the above control, it is also conceivable to use a second temperature sensor 67 disposed in the installation room 29 and measuring the temperature in the installation room 29 to control the valve 20.

In this context, it is conceivable that the zero heat dissipation control is activated (the valve 20 is opened) if the temperature detected by the first temperature sensor 66 is higher than the temperature measured by the second temperature sensor 67. For example, it may be that the controller 65 overrides the above control related to the first temperature sensor 66, if the temperature measured by the second temperature sensor 67 is lower than the temperature detected by the first temperature sensor 66 and closes the valve 20 despite the fact that the temperature measured by the first temperature sensor 66 is higher than the predetermined temperature.

An even further possibility is that instead of using the first temperature sensor 66 to merely use the second temperature sensor 67 and control the valve 20 on the basis of a comparison between the temperature measured by the second temperature sensor 67 and a predetermined temperature. The predetermined temperature may be a no-room-impact-temperature. The predetermined temperature may be selected in the same manner as explained above with respect to the first temperature sensor 66.

According to a first example, it may be sufficient to compare the predetermined temperature and the temperature measured by the second temperature sensor 67 and if the temperature of the second temperature sensor 67 exceeds the selected predetermined temperature, the valve 20 is opened to activate the zero heat dissipation control. Subsequently, if the temperature measured by the second temperature sensor 67 falls below the predetermined temperature minus the differential temperature, the valve 20 is again closed.

According to a second example, it is as well conceivable to define a second differential temperature in the same manner as the first differential temperature. If the temperature measured by the second temperature sensor 67 is higher than the predetermined temperature (no-room-impact-temperature) and the delta between the temperature measured by the second temperature sensor 67 and the predetermined temperature is higher than the second differential temperature, the valve 20 is opened. In the same manner as described above and according to a first possibility, if the temperature measured by the second temperature sensor 67 falls below the predetermined temperature by the first differential temperature, the valve 20 is closed and the zero heat dissipation control is deactivated. Alternatively, the valve 20 may also be closed if the temperature measured by the second temperature sensor 67 falls below the predetermined temperature (no-room-impact-temperature) without the use of the first differential temperature.

An even further control mechanism to activate/deactivate the zero heat dissipation control (open/close the valve 20) may be based on the thermistor 68 disposed at the exit line 69 and particularly the temperature of the refrigerant in the exit line 69 measured by the thermistor 68. Further, the controller 65 uses the pressure measured by the pressure sensor 71 disposed at the gas suction line 26. In particular, the controller 65 concludes on the two-phase temperature (the temperature at which a phase change from liquid to gas takes place) on the basis of the pressure measured by the pressure sensor is 71. Subsequently, the controller 65 compares this two-phase temperature and the temperature measured by the thermistor 68. If the temperature measured by the thermistor 68 is higher than the two-phase temperature, it is concluded that superheated gaseous refrigerant leaves the cooling heat exchanger 22. The output of the thermistor 68 is, hence, used by the controller 65 to conclude or calculate on the basis of a pressure in the gas suction line 26 and the temperature at an outlet of the cooling heat exchanger 22 (cooling heat exchanger gas outlet) on a superheat degree. Subsequently, and depending on the superheat degree the valve 20 is opened or closed. This control is particularly a safety measure to prevent liquid refrigerant from remaining in the exit line 26 and/or being pumped into the accumulator 108 (if present) or the compressor 3. In particular, the controller 65 is configured to switch to the OFF-mode of the valve 20, when the calculated superheat degree falls below a predetermined value for a predetermined period of time. During operation, the pressure difference between the liquid line 25 and the gas suction line 26 will depend on the operational conditions of the heat source unit 2. If there is a pressure drop in the bypass line 24, a refrigerant flow may be induced from the gas suction line 26 into the bypass line 24. Depending on the air temperature in the external housing 10, the refrigerant flowing through the cooling heat exchanger 22 and the thermal capacity of the air may be out of balance resulting in a fully evaporated refrigerant with a possible high superheat or a not fully evaporated refrigerant which contains liquid refrigerant. Those extreme situations may be avoided by opening/closing the valve 20 on the basis of the superheat degree obtained via the thermistor.

As a further aspect, either one of the methods for controlling the opening/closing of the valve 20 described with respect to FIGS. 11 and 12 below may be implemented in any of the previously described embodiments.

In particular, the air conditioner 1 is a variable capacity air conditioner 1 and the compressor 3 may be an inverter driven compressor, wherein the frequency of the compressor 3 may be changed via an inverter 110 (see FIG. 13). The previously mentioned electrical components 36 may comprise the inverter 110.

The inverter 110 may comprise a resistor circuit component 111, a diode module 112 and a power transistor module 113.

The inverter 110 may be mounted to the previously mentioned heat sink 114 comprising a body 115 and a plurality of fins 116 extending from the main body.

The air flowing through the air passage 37 is used to cool the inverter 110 and particularly the power transistor module 113 directly and/or indirectly via the fins 116 of the heat sink 114.

Moreover, a temperature sensor 117 may be provided in order to detect a temperature of the inverter 110, particularly of the power transistor module 113. In one example, the temperature sensor 117 may be mounted to the body 115 of the heat sink 114 at a central position and/or adjacent to the power transistor module 113. Thus, the temperature sensor 117 may actually measure the temperature of the heat sink 114 as a reference temperature to conclude on the temperature of the inverter 110 and particularly the power transistor module 113. The temperature sensor 117 may also directly measure the temperature of the power transistor module.

In this context, it is to be emphasized that the higher the frequency of the compressor 3, the higher the temperature of the power transistor module 113 of the inverter 110 and the higher the temperature measured by the temperature sensor 117.

In a first step S01, the temperature T measured by the temperature sensor 117 is compared with a first reference temperature $T_A$. The reference temperature $T_A$ may for example be 80° C. If the temperature T measured by the temperature sensor 117 exceeds the reference temperature $T_A$, the system concludes that the temperature of the inverter 110 needs to be reduced.

A first measure to reduce the temperature is to reduce the frequency of the compressor 3 from a first frequency during normal operation (first operation mode) by a predetermined or variable frequency to a second frequency (second operation mode) lower than the first frequency. As previously indicated, the frequency of the compressor 3 is directly proportional to the temperature of the power transistor module 113 of the inverter 110.

A second measure is to open the valve 20 in order to cool the inverter 110 and particularly the power transistor module 113 via the air passing through the air passage 37 as previously described.

In order to conclude on how to reduce the temperature, both methods, as described below with respect to FIGS. 11 and 12, calculate and/or conclude on the heat transfer capacity of the air conditioner 1 and the cooling heat exchanger 22. In this context, the heat transfer capacity of the air conditioner is the heat transfer capacity the air conditioner is able to provide for heat exchange at the indoor heat exchanger/-s. The heat transfer capacity of the air conditioner 1 may, hence, also be considered as the heat transfer capacity of the system of the air conditioner 1 or system capacity. The heat transfer capacity of the air conditioner 1 ($Q_1$ and $Q_2$) and the heat transfer capacity of the cooling heat exchanger 22 ($Q_3$) may be calculated during cooling operation as explained in the following with respect to the Mollier diagram (p-h graph of the refrigeration cycle) in FIG. 14.

$Q_1$=(Refrigerant circulation amount at a first frequency of the compressor)*(specific enthalpy at the point $A$−specific enthalpy at the point $E$)

$Q_2$=(Refrigerant circulation amount at a second frequency of the compressor)*(specific enthalpy at the point $A$−specific enthalpy at the point $E$)

$$Q3 = 27.09 * CV1 * \left[\frac{PL - LP}{\frac{1}{\rho L}}\right]^{\frac{1}{2}}$$

CV1: Flow coefficient value of the cooling heat exchanger 22

PL: The saturated pressure calculated from the temperature of a TL temperature sensor which detects the liquid refrigerant temperature flowing in the liquid refrigerant pipe LP: The low-pressure value detected by a low-pressure sensor which is disposed at the gas suction line 26

ρL: The saturated liquid density calculated from PL

In this regard, a first heat transfer capacity $Q_1$ at a first frequency of the compressor 3 during a first operation mode (normal operation) of the air conditioner and a second heat transfer capacity $Q_2$ at the second frequency of the compressor 3 during a reduced frequency operation (second operation mode, e.g. compressor protection mode) are determined and the difference $Q_H$ between the first heat transfer capacity $Q_1$ and the second heat transfer capacity $Q_2$ is calculated ($Q_H$=$Q_1$−$Q_2$). In this regard, the first heat transfer capacity $Q_1$ is the actual heat transfer capacity of the air conditioner 1 before the operational condition to reduce the frequency by a predetermined amount occurred (such as that the temperature of the inverter 110 exceeds a certain value). The second heat transfer capacity $Q_2$ is the heat transfer capacity of the air conditioner 1 after an actual or theoretical reduction of the frequency by a predetermined amount. In particular, the reduction of the frequency may also depend on other parameters, in which case a theoretical reduced frequency capacity is calculated. In this regard and depending on occurrence of the operational condition to reduce the frequency, the amount at which the frequency is reduced can be different.

Moreover, the heat transfer capacity $Q_3$ of the cooling heat exchanger 22 is determined.

In subsequent steps, the difference $Q_H$ is compared with the heat transfer capacity Q3 of the cooling heat exchanger 22. This comparison is used to decide whether the valve 20 is opened (kept open) or closed (kept closed) as will be explained in more detail below.

First, the method as shown in FIG. 11 will be explained in more detail.

As previously indicated during normal operation of the air conditioner (e.g. cooling operation), in which the compressor 3 is driven at the first frequency, the temperature T measured by the temperature sensor 117 is compared to the reference temperature $T_A$ (e.g. 80° C.) in step S01. If the temperature T is smaller than the reference temperature $T_A$, the control will again compare the temperature T with the reference temperature $T_A$ after a certain time interval has lapsed. If the temperature T is larger than the reference temperature $T_A$, the method proceeds to step S02.

In the step S02, the controller 65 of the air conditioner reduces the frequency of the compressor 3 to a predetermined frequency (second frequency) lower than the first frequency. This may be considered as a specific operational condition to reduce the compressor frequency. The reduction of the frequency may be performed in one step or in a plurality of steps in order to provide for a smooth transition between the two frequencies. Accordingly, the temperature of the inverter 110 and particularly the power transistor module 113 will decrease due to the lower frequency.

In order to accelerate the reduction of the temperature T, the method calculates or determines the difference $Q_H$ between the first heat transfer capacity $Q_1$ and the second heat transfer capacity $Q_2$ ($Q_H=Q_1-Q_2$) and the heat transfer capacity $Q_3$ of the cooling heat exchanger 22 (step S03).

In step S04, the difference $Q_H$ is compared with the heat transfer capacity $Q_3$. If the difference $Q_H$ is smaller than the heat transfer capacity $Q_3$, the method returns to the step S03. If the difference $Q_H$ is larger than the heat transfer capacity $Q_3$, the controller 65 is configured to open the valve 20 and, hence, the start of the above-described zero heat dissipation control (step S05).

The comparison of the difference $Q_H$ and the heat transfer capacity $Q_3$ subsequently continues and if the capacity $Q_H$ becomes smaller than the heat transfer capacity $Q_3$ in step S06, the valve 20 is closed and the zero heat dissipation control is stopped (step S07).

Subsequently, the method returns to step S03.

If during the above control method the temperature T measured by the temperature sensor 117 falls below a predetermined second reference temperature $T_B$ (e.g. 75° C.) (step S08), the air conditioner is returned to normal operation at which the compressor 3 is operated at the first frequency and the control method is returned to step S01.

According to this control method, effective cooling of the inverter 110 may be performed. Hence, the mode (reduced frequency mode or second operation mode), in which the system capacity is reduced, may be reduced to a minimum.

It is clear that the method in FIG. 11 may alternatively or additionally to the above-described control methods be implemented into the air conditioner 1.

An alternative method is described with respect to FIG. 12. This alternative method also comprises the step S01. However, if the controller 65 in step S01 determines that the temperature T is larger than the reference temperature $T_A$, the controller proceeds to step S03 corresponding to step S03 as explained above.

Subsequently, the difference $Q_H$ is compared with the heat transfer capacity $Q_3$ of the cooling heat exchanger 22 (step S09).

If the difference $Q_H$ is larger than the heat transfer capacity $Q_3$, the valve 20 is opened (or kept open) and the zero heat dissipation control is started (or continued). In addition, the frequency of the compressor 3 is maintained, e.g. at the first frequency (step S10).

If the difference $Q_H$ is smaller than the heat transfer capacity $Q_3$, the valve 20 is closed (or kept closed) and the zero heat dissipation control is stopped (or not started). In addition, the frequency of the compressor 3 is reduced to the second predetermined frequency via the inverter 110.

Again, if during the above control method the temperature T measured by the temperature sensor 117 falls below a predetermined second reference temperature $T_B$ (e.g. 75° C.) (step S08), the air conditioner is returned to normal operation (first operation mode) at which the compressor 3 is operated at the first frequency and the control method is returned to step S01.

As compared to the previous embodiment, this alternative method in FIG. 12 may avoid the necessity to reduce the compressor frequency to the second frequency and, hence, to maintain the full system capacity of the air conditioner 1 still enabling a sufficient cooling of the inverter 110.

Also, this alternative method may be implemented with any of the previously described control methods.

In addition, in either one of the methods described with respect to FIGS. 11 and 12, the operational condition triggering the reduction of the frequency is the temperature of the inverter 110. Thus, even if the reduced frequency has not been implemented as in the methods described with respect to FIG. 12, the controller is already capable to calculate the heat transfer capacity $Q_2$ of the air conditioner 1 theoretically in order to decide whether the frequency actually has to be reduced.

REFERENCE SIGNS LIST

Air conditioner 1
Heat source unit 2
Compressor 3
4-Way valve 4
Heat source heat exchanger 5
Expansion valve 6
Optional expansion valve 7
Liquid receiver 8
Oil separator 9
External housing 10
Exterior of the external housing 11
Interior of the external housing 12
Top of the external housing 13
Bottom of the external housing 14
Side walls of the external housing 15
Drain Pan 16
Vents 17
Valve 20
Capillary 21
Cooling heat exchanger 22
Duct 23
Bypass line 24
Liquid refrigerant line 25
Gas suction line 26
Air inlet of cooling heat exchanger 27

Air outlet of the cooling heat exchanger 28
Installation room 29
Electric box 30
Top of the electric box 31
Back of the electric box 32
Front of the electric box 33
Sides of the electric box 34
Bottom of the electric box 35
Electrical components 36
Air passage 37
Air inlet of the air passage 38
Air outlet of the air passage 39
Fan 40
Air flow 41
Fins 42
Tubes 43
Bottom end portion of the cooling heat exchanger 44
Support structure 45
Axis of rotation 46
Frame 47
Column 48
Slot 49
Boss 50
Insertion portion 51
Opening of the insertion portion 52
Engagement portion 53
Lower section 54
Upper section 55
Center of gravity 56
Bolts 57
Opening 59
Sealing 60
Plane of the contact surface of the sealing 61
First electric wire 62
Second electric wire 63
Handle 64
Controller 65
First temperature sensor 66
Second temperature sensor 67
Thermistor 68
Exit line 69
Opening 70
Pressure sensor 71
Indoor unit 100 to 102
Indoor heat exchanger 103
Water circuit 104
Rooms 105
Maintenance wall 106
Bolts 107
Accumulator 108
Outdoor unit 109
Inverter 110
Resistor circuit component 111
Diode module 112
Power transistor module 113
Heat sink 114
Body 115
Fins 116
Temperature sensor 117

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A heat source unit for an air conditioner that comprises a refrigerant circuit, the heat source unit comprising:
an external housing that accommodates:
a compressor connected to the refrigerant circuit;
a heat source heat exchanger that is connected to the refrigerant circuit and that exchanges heat between a refrigerant circulating in the refrigerant circuit and a heat source; and
an electric box that:
includes a top and a plurality of side walls;
accommodates electrical components that control the air conditioner; and
further includes an air passage comprising an air inlet and an air outlet, wherein an air flow is induced through the air passage from the air inlet to the air outlet for cooling at least some of the electrical components;
a cooling heat exchanger disposed in the external housing and that is connected to the refrigerant circuit, wherein the air flow flows through the cooling heat exchanger, and
the cooling heat exchanger exchanges heat between the refrigerant and the air flow, and is connected to a bypass line disposed between a liquid refrigerant line and a gas suction line;
a valve disposed on the bypass line upstream of the cooling heat exchanger; and
a controller that controls the valve to switch between an OFF-mode in which the valve is closed and an ON-mode in which the valve is opened, wherein
the controller switches between the OFF-mode and the ON-mode based on operation conditions of the air conditioner, and
the controller switches the valve to the OFF-mode during special control modes of the air conditioner, wherein the special control modes include a start-up of the air conditioner and oil return operations.

2. The heat source unit according to claim 1, further comprising a capillary disposed on the bypass line upstream of the cooling heat exchanger.

3. The heat source unit according to claim 1, wherein the controller allows manual setting of the OFF-mode.

4. The heat source unit according to claim 1, wherein the controller switches the valve to the OFF-mode when a required cooling capacity of the air conditioner exceeds a predetermined threshold.

5. The heat source unit according to claim 1, further comprising:
a temperature sensor disposed within the external housing, wherein
the controller switches between the ON-mode and the OFF-mode of the valve based on a temperature measured by the temperature sensor.

6. The heat source unit according to claim 5, wherein the controller switches to the ON-mode when the temperature measured by the temperature sensor is higher than a predetermined temperature.

7. The heat source unit according to claim 1, further comprising:
a temperature sensor disposed at an exit line between an exit of the cooling heat exchanger and a connection of the bypass line to the gas suction line, wherein
the controller:
determines a superheat degree of the refrigerant in the exit line based on a temperature detected by the temperature sensor, and switches between the ON-mode and the OFF-mode of the valve based on the determined superheat degree.

8. The heat source unit according to claim 7, wherein the controller switches to the OFF-mode of the valve when the superheat degree falls below a predetermined value for a predetermined period of time.

9. The heat source unit according to claim 1, wherein the external housing comprises vents.

* * * * *